US007798593B2

(12) United States Patent
Nitta et al.

(10) Patent No.: US 7,798,593 B2
(45) Date of Patent: Sep. 21, 2010

(54) INK JET PRINTING APPARATUS AND METHOD FOR CONTROLLING TEMPERATURE OF THE SAME

(75) Inventors: Masaki Nitta, Yokohama (JP); Hajime Nagai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 391 days.

(21) Appl. No.: 11/692,264

(22) Filed: Mar. 28, 2007

(65) Prior Publication Data

US 2007/0229599 A1 Oct. 4, 2007

(30) Foreign Application Priority Data

Mar. 30, 2006 (JP) ..... 2006-095117

(51) Int. Cl.
*B41J 29/38* (2006.01)

(52) U.S. Cl. ..... 347/17; 347/14

(58) Field of Classification Search ..... 347/14, 347/54, 56, 17, 37

See application file for complete search history.

(56) References Cited

U.S. PATENT DOCUMENTS 6,086,180 A * 7/2000 Sugimoto et al. ..... 347/14
6,585,343 B2 * 7/2003 Bauer ..... 347/14

FOREIGN PATENT DOCUMENTS

JP 5-220965 8/1993
JP 8-058077 3/1996

* cited by examiner

*Primary Examiner*—Stephen D Meier
*Assistant Examiner*—Geoffrey Mruk
(74) *Attorney, Agent, or Firm*—Fitzpatrick, Cella, Harper & Scinto

(57) ABSTRACT

An ink jet printing apparatus and method can perform temperature control before printing so as to provide for a decrease in the temperature of a print head during printing without using any sub-heaters, to establish a favorable ejection state while preventing the head temperature from decreasing below a predetermined value. Information on scan width and dot count is acquired before the carriage starts a scan. A temperature adjustment temperature for the print head is then determined on the basis of the information acquired.

6 Claims, 7 Drawing Sheets

| AREA | SCAN WIDTH | | | |
|---|---|---|---|---|
| | ~215mm | 216~ 350mm | 351~ 700mm | 701mm~ |
| Ta | 3℃ | 5℃ | 7℃ | 10℃ |

FIG.5

| ENVIRONMENTAL TEMPERATURE | ENVIRONMENTAL HUMIDITY | SCAN WIDTH | | | |
|---|---|---|---|---|---|
| | | ~215mm | 216~ 350mm | 351~ 700mm | 701mm~ |
| ~18°C | ~35% | 6℃ | 6℃ | 10℃ | 10℃ |
| 19~28°C | ~35% | 5℃ | 5℃ | 9℃ | 9℃ |
| 29°C~ | ~35% | 4℃ | 4℃ | 8℃ | 8℃ |
| ~18°C | 36~65% | 4℃ | 4℃ | 8℃ | 8℃ |
| 19~28°C | 36~65% | 3℃ | 3℃ | 7℃ | 7℃ |
| 29°C~ | 36~65% | 2℃ | 2℃ | 6℃ | 6℃ |
| ~18°C | 66%~ | 2℃ | 2℃ | 6℃ | 6℃ |
| 19~28°C | 66%~ | 1℃ | 1℃ | 5℃ | 5℃ |
| 29°C~ | 66%~ | 0℃ | 0℃ | 4℃ | 4℃ |

FIG.7

INK JET PRINTING APPARATUS AND METHOD FOR CONTROLLING TEMPERATURE OF THE SAME

BACKGROUND OF THE INVENTION

1. Field of the Invention

The present invention relates to a method for controlling the temperature of a print head in an ink jet printing apparatus.

2. Description of the Related Art

Ink jet printing apparatuses are based on what is called a non-impact printing scheme and characterized by their ability to print various print media at high speeds and little noise involved in printing. Ink jet printing apparatuses are thus commonly employed as printing mechanisms for various apparatuses such as printers, word processors, facsimile machines, and copiers.

The ink jet printing apparatus is generally composed of an ink jet print head comprising ejection ports from which ink is ejected and a supply system that supplies ink to the print head. A typical scheme for ink ejection uses electrothermal conversion elements (hereinafter referred to as heaters). With this scheme, an electric pulse serving as a print signal is provided to electrothermal conversion elements disposed in a pressurization chamber located inward of the ejection ports, to generate heat. Thermal energy is thus applied to ink, which thus has its phase changed to generate bubbles. The pressure of the bubbles is used to eject print droplets for printing. This scheme makes it possible to easily and accurately manufacture a print element substrate provided densely with a large number of electrothermal conversion elements, wires, and the like, via a manufacturing process similar to that for semiconductors. This in turn enables printing at a higher resolution and a higher speed. As a result, the sizes of printing apparatuses using ink jet print heads can be further reduced.

With the method for ink jet printing, the temperature of ink is a very important parameter in keeping constant the level of stability of ink ejection and the amount of ink ejected. This is because physical properties such as ink viscosity and surface tension vary with temperature, thus varying an ejection state. In particular, in a low temperature environment, the increased ink viscosity may make ejection unstable to degrade print quality. Thus, when an apparatus is used for printing, the ink may be heated to a given temperature before printing is started. To achieve this, heaters for a purpose other than ejection may be provided inside or outside the print head. Further, if ejection is not performed for a given time, moisture unavoidably evaporates from the ink in the vicinity of the ejection ports to increase the ink viscosity, degrading the ejection state. Thus, a recovery operation (preliminary ejection) is performed in which a given amount of ink is ejected during printing or before starting a new printing operation and until normal ejection can be performed in a place other than a print area. When a recovery operation is performed during printing, the printing is suspended, reducing print speed. To minimize the number of recovery operations, the temperature of the ink may be controlled by adjusting the temperature of the head so as to improve the ink ejection state. To control the ink temperature, a heating source such as heat retaining heaters (sub-heaters) is provided on the same substrate with ejection heaters which heat the ink to generate bubbles so that the pressure of the bubbles causes the ink to be ejected. Japanese Patent Laid-Open No. 5-220965 proposes a configuration that directly or indirectly heats ink using the above method. A method for heating ink using ejection heaters involves detecting the temperature of the print head, driving the heaters with a pulse of an appropriate pulse width insufficient for causing bubbling (short pulse) until a predetermined temperature is reached, and stopping energization when the predetermined temperature is reached. A method for heating ink using sub-heaters involves detecting the temperature of the print head, energizing the sub-heaters until a predetermined temperature is reached, stopping energization when the predetermined temperature is reached, and subsequently performing energization again when a certain temperature is reached. On the other hand, Japanese Patent Laid-Open No. 8-58077 proposes a heating arrangement using only a plurality of sub-heaters with different heating values. First, sub-heaters with a larger heating value are used for rapid heating, and a certain time later, sub-heaters with a smaller heating value are used to control the temperature so that the head temperature will not become excessively high while reducing the time required for heating.

However, providing sub-heaters in the print head as is the case with the conventional techniques requires the corresponding space. However, it is difficult to provide such a space in the recent print heads that tend to have densely integrated nozzles. Further, with sub-heaters, temperature control needs to be performed on both ejection heaters and sub-heaters. This complicates the controlling operation itself.

On the other hand, if the ink temperature is controlled using only the ejection heaters without providing any sub-heaters, temperature control must be performed between ink ejections during printing. This not only reduces the print speed but also complicates the controlling operation. The constitution in which the temperature is controlled until immediately before the ink ejecting, and the constitution in which the temperature is not controlled while printing, may be adopted, in order to avoid reducing the print speed and complicating the controlling operation. However, in such a constitution in which the temperature is not controlled while printing, a long print time or a small amount of an image data to be printed may lower the head temperature below the desired value. This prevents the desired ejection state from being established.

SUMMARY OF THE INVENTION

Thus, an object of the present invention is to provide an ink jet printing apparatus that can perform temperature control before printing so as to provide for a decrease in the temperature of a print head during printing without using any sub-heaters, to establish a favorable ejection state while preventing the head temperature from decreasing below a predetermined value, as well as a method for controlling the temperature of the ink jet printing apparatus.

According to one aspect, the present invention relates to an ink jet printing apparatus including an ejection heater, a print head that ejects ink when heated by the ejection heater, and a carriage on which the print head is mounted, the apparatus printing a print medium by scanning the print head mounted on the carriage, the apparatus comprising:

head temperature acquiring means for acquiring the temperature of the print head; and means for determining an adjustment temperature for the print head on the basis of the scan width of the carriage and the amount of printing during a scan and driving the ejection heater in the print head in accordance with the set adjustment temperature to adjust the temperature of the print head before starting a scan.

According to the present invention, before the carriage is scanned, a decrease in the temperature of the print head during printing is predicted on the basis of the scan width and the dot count, that is, the number of droplets ejected. The predicted temperature is added to the target temperature adjustment temperature to determine the final temperature adjustment temperature. This makes it possible to prevent the temperature of the print head from reaching the predetermined value or smaller during printing. Consequently, a favorable ejection state can be established.

Further features of the present invention will become apparent from the following description of exemplary embodiments (with reference to the attached drawings).

BRIEF DESCRIPTION OF THE DRAWINGS

FIG. 5 is a diagram showing the relationship between scan width and a parameter in accordance with the first embodiment;

FIG. 7 is a diagram showing the relationship between a parameter and scan width, environmental temperature, and environmental humidity in accordance with the first embodiment.

DESCRIPTION OF THE EMBODIMENTS

The present invention will be described below with reference to the drawings.

(General Configuration)

Figure 1:
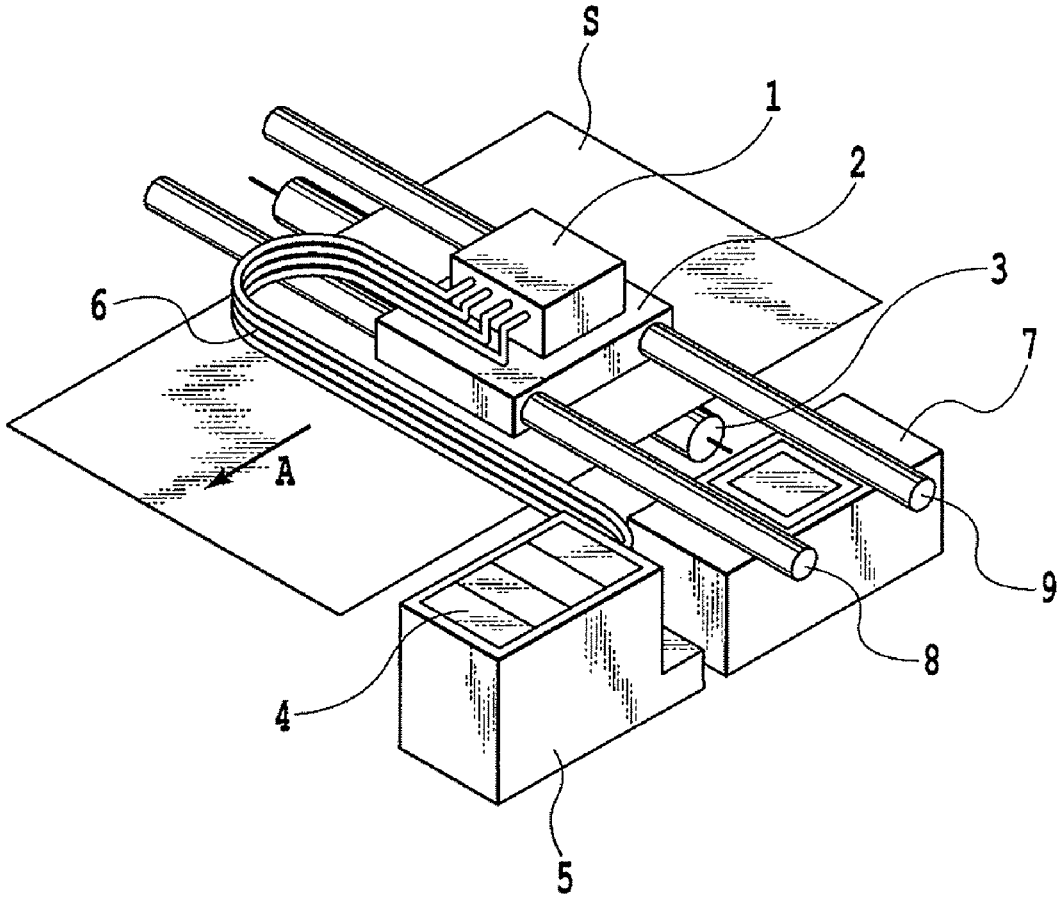
FIG. 1 is a perspective view showing the configuration of an ink jet printing apparatus in accordance with an embodiment of the present invention.

FIG. 1 is a perspective view showing the configuration of an ink jet printing apparatus in accordance with an embodiment of the present invention. A print head 1 is removably mounted on a carriage 2 supported by two guide rails 8 and 9 and reciprocated along the guide rails 8 and 9 by driving means such as a motor (not shown). A print medium S is conveyed by a conveying roller 3 in a direction (the direction of arrow A) crossing the moving direction of the carriage 2 so as to move opposite an ink ejection surface of the print head 1 and maintaining a fixed distance from the ink ejection surface. The ink jet printing apparatus in accordance with the present embodiment forms characters or images on the print medium S by repeating reciprocation of the print head 1 and conveyance of the print medium S by a predetermined pitch, while allowing the print head 1 to selectively eject ink in synchronism with the reciprocation and conveyance.

An ink supply unit 5 has ink tank units 4 for respective colors removably installed thereon. The ink supply unit 5 and the print head 1 are connected together by an ink supply tube. Color inks housed in the respective ink tank units are independently supplied. At a home position of the carriage 2, a recovery unit 7 is provided at a position where the carriage 2 having returned the home position sits opposite the ejection surface of the print head 1. The recovery unit 7 comprises a cap (not shown) that caps the ejection surface of the print head 1. The recovery unit 7 further comprises a sucking mechanism (not shown) that sucks ink or the like collected in the ejection ports while the ejection surface is capped, and a cleaning blade (not shown) that wipes off the ejection surface. The apparatus comprises, in an area unlikely to be affected by heat from the substrate, a temperature sensor (not shown) that acquires the environmental temperature of vicinity of the print head 1 and a temperature sensor (not shown) that acquires the environmental temperatures of other areas.

Figure 2:
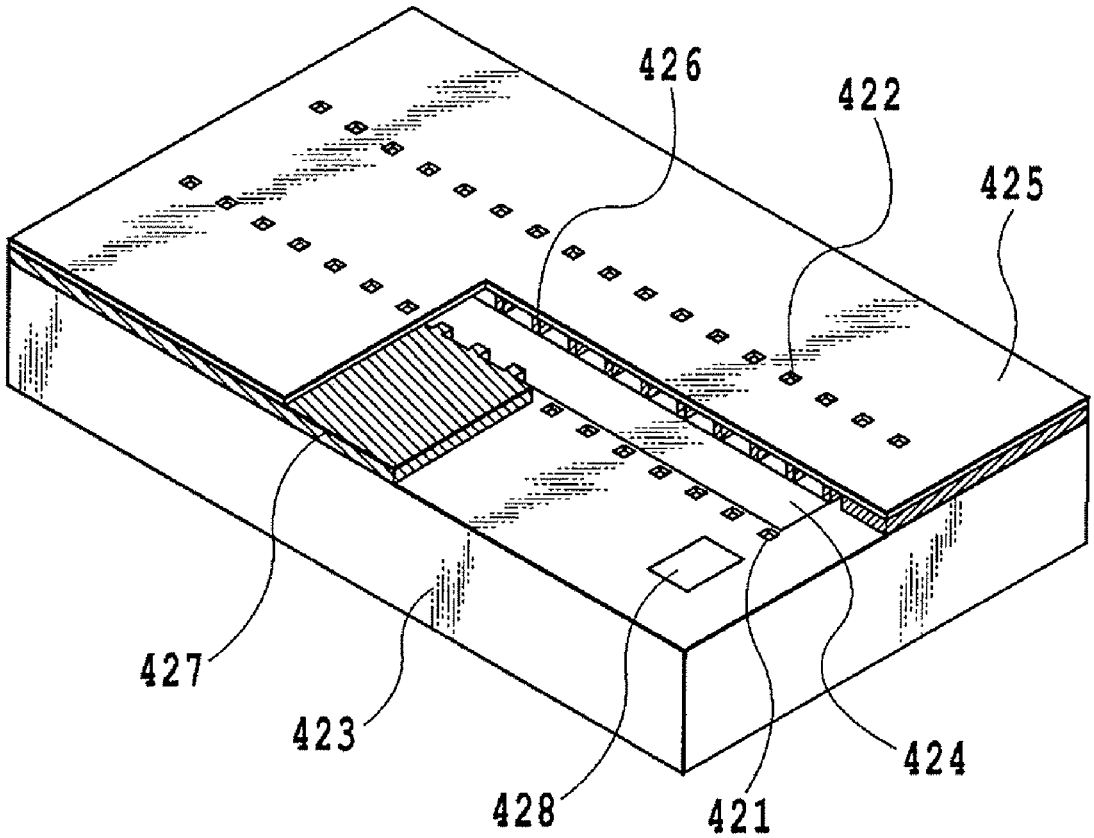
FIG. 2 is a partial sectional perspective view showing the structure of part of the vicinity of ejection ports in a print head.

FIG. 2 is a partial sectional perspective view showing the vicinity of ejection ports in the print head 1. The print head 1 comprises an ink supply port 424 in the center of an element substrate 423 and heaters 421 provided for respective ejection ports 422. A resin coating layer 427 is provided between the element substrate 423 and an ejection port plate 425 so as to form a channel wall of an ink channel. A temperature sensor 428 that detects the temperature of the print head 1 is provided in the same surface of the element substrate 423 which has the heaters 421.

Figure 3:
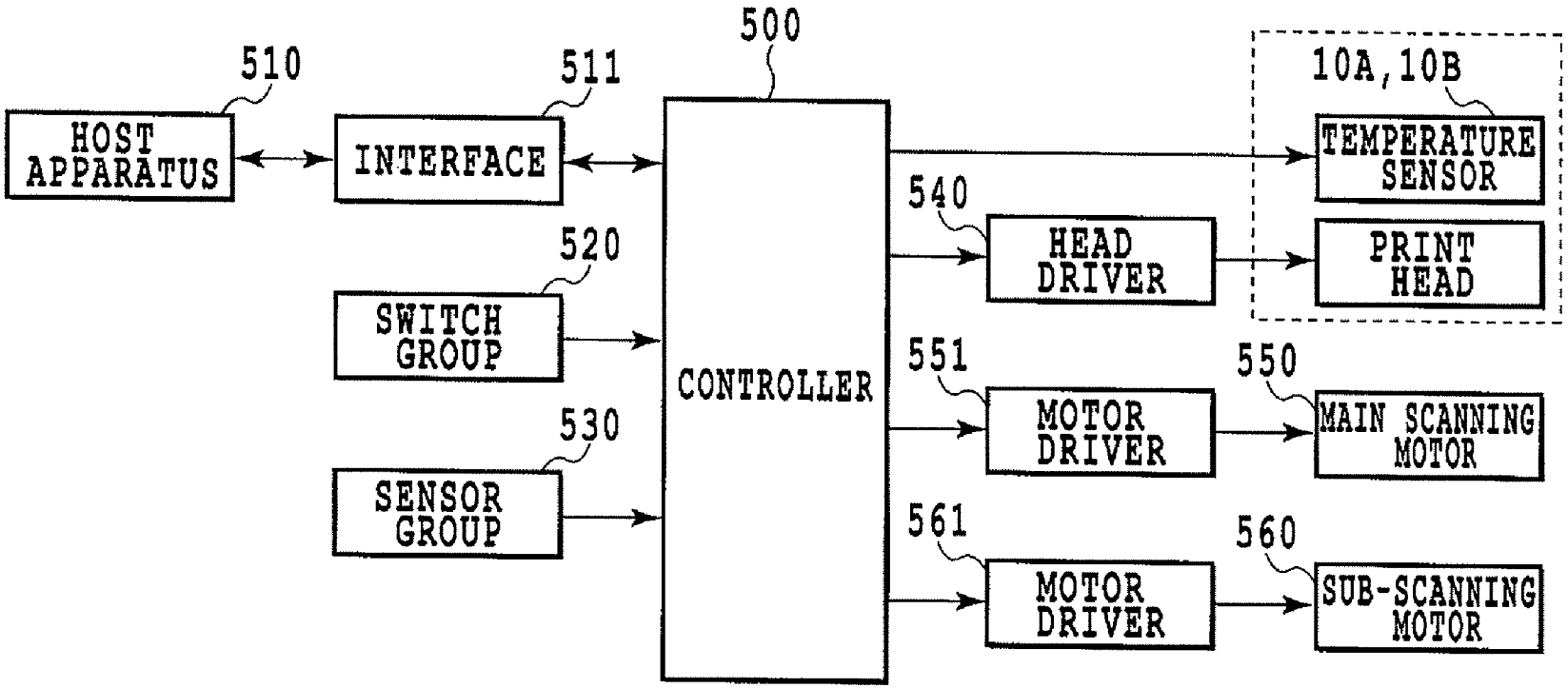
FIG. 3 is a block diagram showing the configuration of a control system in an ink jet printing apparatus in accordance with an embodiment of the present invention.

FIG. 3 is a block diagram showing the configuration of a control system in an ink jet printing apparatus in accordance with an embodiment of the present invention. A controller 500 mainly controls the ink jet printing apparatus transmits and receives print data, status signals, and the like to and from a host apparatus 510 via an interface 511; the host apparatus 510 supplies print data. The controller 500 can also receive commands issued by an operator via a group of switches 520, and also receives signals from a group of sensors 530 that detects the state of the apparatus. The controller 500 also transmits signals to a head driver 540 and a motor driver 561 on the basis of received signals and data to control a main scanning motor 550 and a sub-scanning motor 560 during printing.

The present embodiment uses the print head 1 provided with four color inks, black (Bk), cyan (C), magenta (M), and yellow (Y) to perform printing. The inks have the property of having their ejection states improved when heated.

Figure 4:
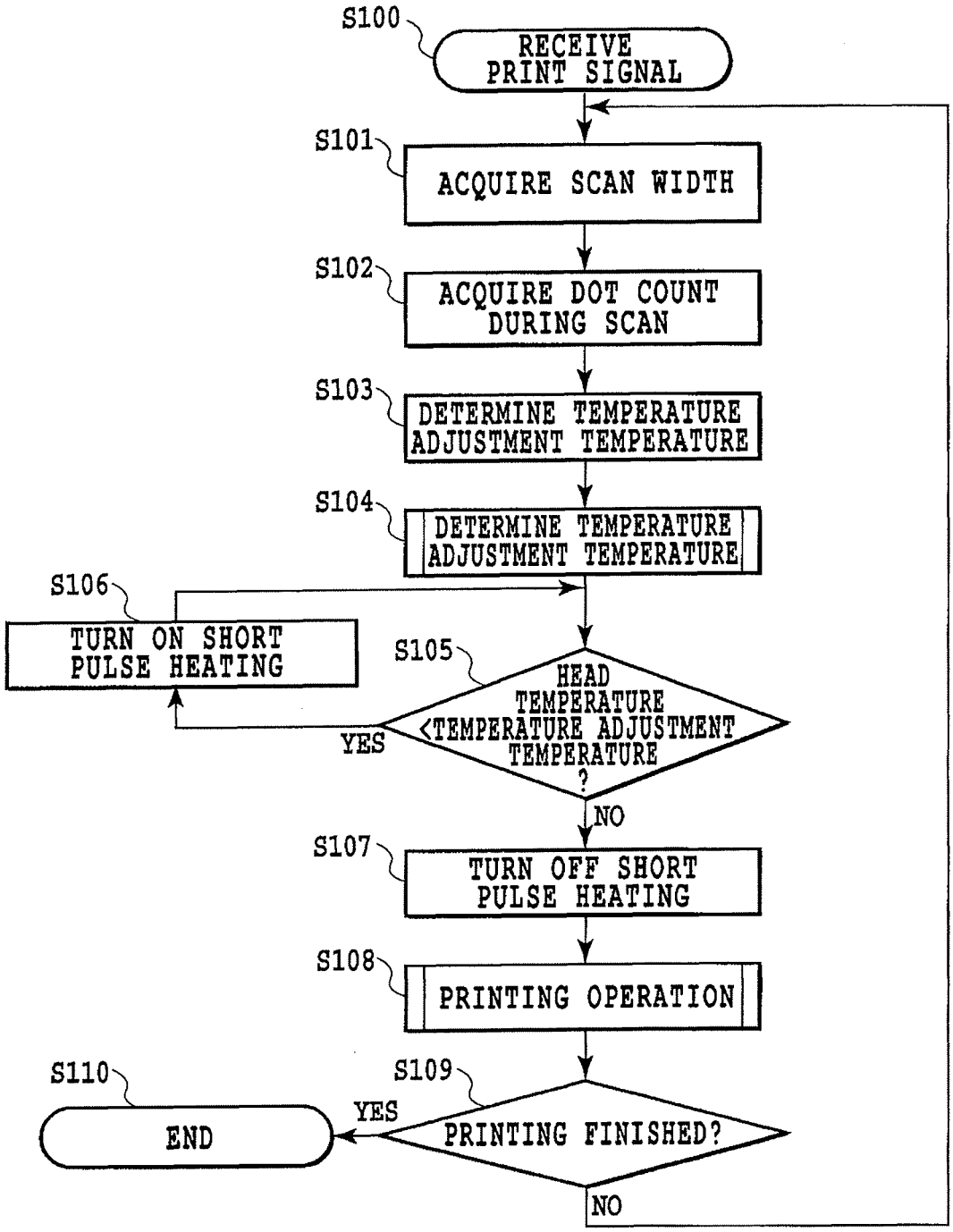
FIG. 4 is a flowchart showing the flow of processing in accordance with a first embodiment.

FIG. 4 is a flowchart showing the flow of processing executed by an ink jet printing apparatus in accordance with the present embodiment. In step S100, the ink jet printing apparatus receives a signal for print start. In step S101, for printing for one scan, the apparatus acquires the scan width of the carriage 2 performing printing. In step S102, on the basis of the print data for one scan, the apparatus acquires the number of ink droplets ejected (hereinafter also referred to as a dot count). Then, in step S103, a temperature adjustment temperature correction value is determined on the basis of the dot count and the scan width of the carriage 2 acquired in step S101. In step S104, an adjustment temperature, the target for adjustment of the temperature of the print head, is set in accordance with the correction value.

The temperature adjustment temperature correction value increases consistently with the scan width and decreases with increasing dot count. A method for calculating the temperature adjustment temperature correction value will be described with a specific example.

The temperature adjustment temperature correction value is determined as follows:

$$Tup = Ta - Tb \times \text{dot count}$$

where Ta is a parameter corresponding to a predetermined scan width and having a value in accordance with the table in FIG. 5, and Tb is an inherent parameter of the print head; in the present embodiment, the inherent parameter has a value of $8.36\times10^{-6}$.

For example, when the carriage 2 has a scan width of at least 701 mm and a dot count of $5.98\times10^{5}$, 10 is substituted into Ta. Since Tb has a fixed value of $8.36\times10^{-6}$ and the dot count is $5.98\times10^{5}$, substituting these values into the above equation determines the temperature adjustment temperature correction value Tup as follows:

$$Tup=10-8.36\times10^{-6}\times5.98\times10^{5}\cong5.$$

Thus, in this case, the temperature adjustment temperature correction value is 5.

If the above equation results in a large dot count, the temperature adjustment temperature correction value Tup may be negative. In this case, the temperature adjustment temperature correction value Tup is set at zero. If the scan width is so large that the temperature of the print head 1 is expected to decrease significantly during a period corresponding to the scan width, the temperature adjustment temperature correction value Tup is set larger. Further, when the dot count is so large that ink ejection does not easily reduce the temperature of the print head 1, the temperature adjustment temperature correction value Tup is set smaller.

The above equation determines the temperature adjustment temperature correction value Tup in step S103. Subsequently, in step S104, step S103 is used to determine a final temperature adjustment temperature Tf. The final temperature adjustment temperature Tf is determined by adding the temperature adjustment temperature correction value Tup to an uncorrected temperature adjustment target temperature Tt.

$$Tf=Tt+Tup.$$

Accordingly, when the above example is applied to the case where Tt is 35, $$Tf=35+5=40.$$

The final temperature adjustment temperature Tf, the corrected temperature, is 40° C. The final temperature adjustment temperature Tf is the value to which the temperature of the print head is adjusted, that is, the target for the adjusted temperature.

Then, in step S105, the temperature of the print head 1 is checked. If the temperature of the print head 1 is lower than the final temperature adjustment temperature Tf, the process proceeds to step S106 to heat the print head 1 with a short pulse. If in step S105, the temperature of the print head 1 is higher than the final temperature Tf, the process proceeds to step 107, where short pulse heating is not performed. The process thus proceeds to step S108 to start printing. Subsequently, in step S109, the process determines whether or not printing has been finished. If printing has not been finished, the process returns to step S101 to repeat the process. If printing has been finished in step S109, the process proceeds to step S110 to finish the operation.

As described above, scan width information and dot count information are acquired before the carriage 2 starts scanning to enable the prediction of a decrease in the temperature of the print head 1 during scan. Addition of an expected decrease in the temperature of the print head 1 to the temperature adjustment temperature makes it possible to prevent the temperature of the print head 1 from decreasing to a predetermined value or less during printing. As a result, a favorable ejection state can be established.

Second Embodiment

The first embodiment determines the temperature adjustment temperature correction value Tup on the basis of the scan width and the dot count. However, the present embodiment determines the temperature adjustment temperature correction value Tup on the basis of the scan width and dot count as well as environmental temperature and environmental humidity. The method for determination will be described below.

Figure 6:
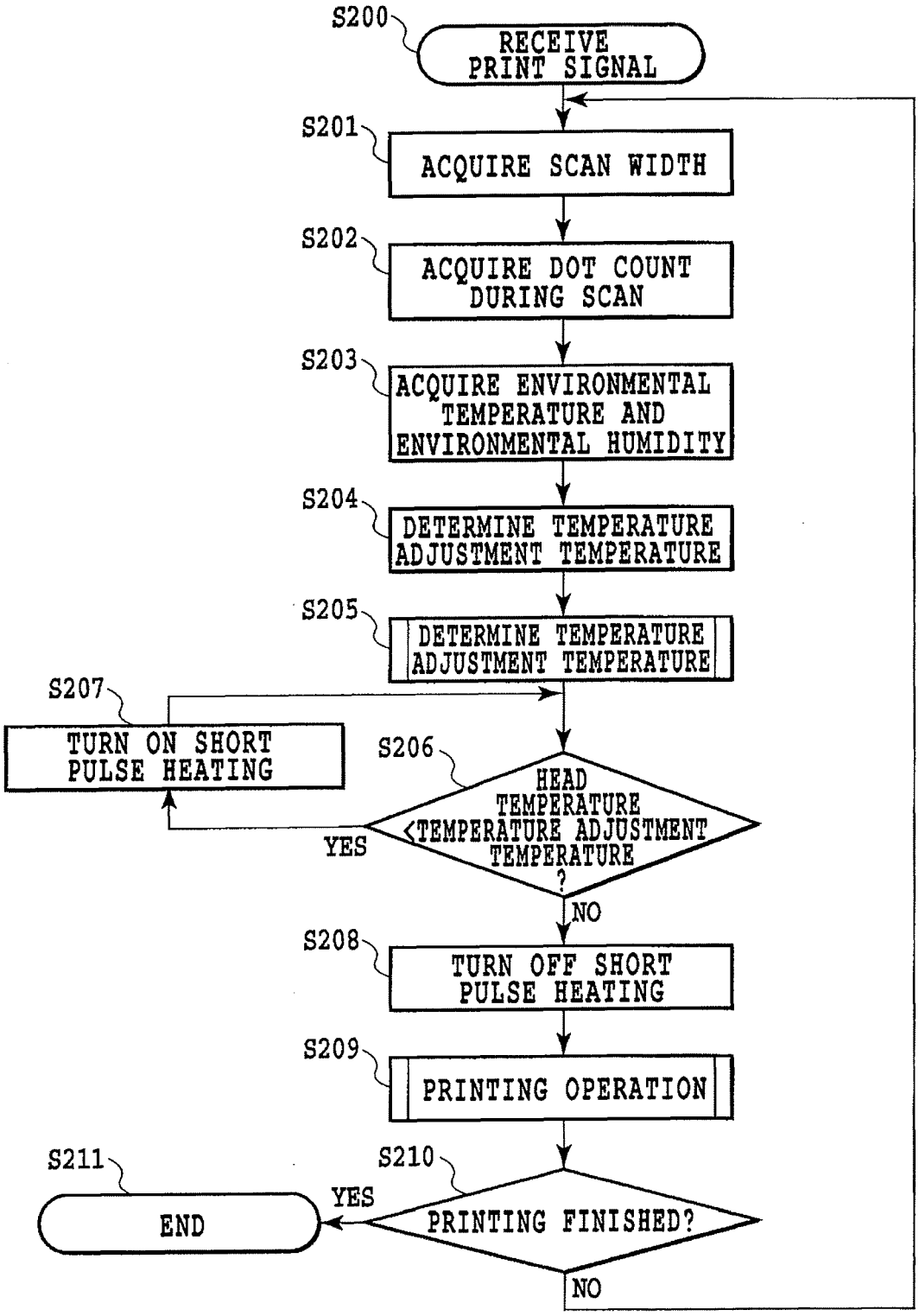
FIG. 6 is a flowchart showing the flow of processing in accordance with a second embodiment.

FIG. 6 is a flowchart showing the flow of a process executed by an ink jet printing apparatus in accordance with the present embodiment. The flowchart in FIG. 6 is different from the flow in FIG. 4 in accordance with the first embodiment only in an additional process of acquiring an environmental temperature and an environmental humidity after the dot count during a scan has been acquired. Accordingly, here, the same parts as those of the flowchart for the first embodiment are omitted. Description will be given of a process from the acquisition of the dot count during a scan until the determination of a temperature adjustment temperature correction value.

After the dot count during a scan is acquired in step S202, an environmental temperature and an environmental humidity are acquired in step S203. Then, in step S204, the temperature adjustment temperature correction value Tup is determined on the basis of the scan width, dot count, environmental temperature, and environmental humidity already acquired. An equation used to calculate a temperature adjustment temperature correction value is the same as that used in the first embodiment except for the parameter Ta. The present embodiment determines the value of Ta with reference to FIG. 7. Description will be given with specific numerical values. For example, when the scan width is at least 701 mm, the environmental temperature is 18° C., and the environmental humidity is at most 35%, Ta is determined to be 10 with reference to FIG. 7. A large dot count may make the temperature adjustment temperature correction value Tup negative. In this case, the temperature adjustment temperature correction value Tup is set at zero as is the case with the first embodiment. In the subsequent steps, a process similar to that of the first embodiment is executed to correct the temperature adjustment target temperature Tt. This enables the more accurate determination of a possible decrease in the temperature of the print head 1 during a scan. Addition of the temperature corresponding to the decrease to the temperature adjustment target temperature Tt makes it possible to prevent the temperature of the print head 1 from decreasing to a predetermined temperature or less. As a result, a favorable ejection state can be established.

The present embodiment uses the environmental temperature and environmental humidity to determine the temperature adjustment temperature correction value Tup. If either of the parameters is determined not to contribute sufficiently to the physical properties of the ink, then similar effects can be produced by addition of only the parameter expected to contribute significantly.

The above embodiments use a 4-color print head. However, the present invention is not limited to this. A print head for a different number of colors such as six colors may also be used. Further, the parameter values shown in FIGS. 5 and 7 vary with the characteristics of the print head and the physical properties of the ink. Accordingly, the present invention is not limited to these values. Desirably, the parameter values are appropriately changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-095117, filed Mar. 30, 2006, which is hereby incorporated by reference herein in its entirety.

What is claimed is:

1. An ink jet printing apparatus including an ejection heater, a print head that ejects ink when heated by the ejection heater, and a carriage on which the print head is mounted, the apparatus printing on a print medium by scanning the print head mounted on the carriage, the apparatus comprising:

head temperature acquiring means for acquiring the temperature of the print head; and adjustment means for determining an adjustment temperature for the print head on the basis of the scan width of the carriage and the amount of printing during a scan, and driving the ejection heater in the print head in accordance with the determined adjustment temperature to adjust the temperature of the print head before starting a scan, wherein the adjustment means adjusts the temperature of the print head such that as the width of the scanning increases, the temperature of the print head is increased.

2. The ink jet printing apparatus according to claim 1, wherein a correction value is determined on the basis of the scan width of the carriage and the number of droplets ejected from the print head, the correction value is added to a temperature adjustment target temperature that is the temperature of the print head to be maintained during printing, to determine the final temperature adjustment temperature, and the correction value increases consistently with the scan width and decreases with an increasing number of droplets ejected.

3. An ink jet printing apparatus including an ejection heater, a print head that ejects ink when heated by the ejection heater, and a carriage on which the print head is mounted, the apparatus printing on a print medium by scanning the print head mounted on the carriage, the apparatus comprising:

head temperature acquiring means for acquiring the temperature of the print head;

environmental information acquiring means for acquiring environmental information on a vicinity of the print head; and adjustment means for determining an adjustment temperature for the print head on the basis of the scan width of the carriage, the amount of printing during a scan, and the environmental information acquired by the environmental information acquiring means, and driving the ejection heater in the print head in accordance with the determined temperature to adjust the temperature of the print head before starting a scan, wherein the adjustment means adjusts the temperature of the print head such that as the width of the scanning increases, the temperature of the print head is increased.

4. The ink jet printing apparatus according to claim 3, wherein the environmental information relates to the temperature or humidity of the vicinity of the print head.

5. A method for controlling the temperature of an ink jet printing apparatus including an ejection heater, a print head that ejects ink when heated by the ejection heater, and a carriage on which the print head is mounted, the apparatus printing on a print medium by scanning the print head mounted on the carriage, the method comprising:

a step of acquiring the temperature of the print head; and a step of determining an adjustment temperature for the print head on the basis of the scan width of the carriage and the amount of printing during a scan, and driving the ejection heater in the print head in accordance with the determined temperature to adjust the temperature of the print head before starting a scan, wherein the temperature of the print head is adjusted such that as the width of the scanning increases, the temperature of the print head is increased.

6. A method for controlling the temperature of an ink jet printing apparatus including an ejection heater, a print head that ejects ink when heated by the ejection heater, and a carriage on which the print head is mounted, the apparatus printing on a print medium by scanning the print head mounted on the carriage, the method comprising:

a step of acquiring the temperature of the print head;

a step of acquiring environmental information on a vicinity of the print head; and a step of determining an adjustment temperature for the print head on the basis of the scan width of the carriage, the amount of printing during a scan, and the environmental information on the vicinity of the print head, and driving the ejection heater in the print head in accordance with the determined adjustment temperature to adjust the temperature of the print head before starting a scan, wherein the temperature of the print head is adjusted such that as the width of the scanning increases, the temperature of the print head is increased.

* * * * *